US007895756B1

(12) United States Patent
Lin

(10) Patent No.: US 7,895,756 B1
(45) Date of Patent: Mar. 1, 2011

(54) PUNCH PLIERS HAVING LOWER COSTS OF FABRICATION

(75) Inventor: Robert Lin, Chang-Hua Hsien (TW)

(73) Assignee: Qualipro Enterprise Co., Ltd., Chang-Hua Hsien (TW)

( * ) Notice: Subject to any disclaimer, the term of this patent is extended or adjusted under 35 U.S.C. 154(b) by 284 days.

(21) Appl. No.: 12/115,669

(22) Filed: May 6, 2008

(51) Int. Cl.
*B26B 17/00* (2006.01)

(52) U.S. Cl. ..... 30/192; 30/187

(58) Field of Classification Search ..... 30/190, 30/192, 251; 81/416, 427.5
See application file for complete search history.

(56) References Cited

U.S. PATENT DOCUMENTS 2,523,610 A * 9/1950 Caddy ..... 30/252
3,323,209 A * 6/1967 Brill, Jr. ..... 30/192
2003/0136008 A1* 7/2003 Lin ..... 30/250

* cited by examiner

*Primary Examiner*—Kenneth E. Peterson
(74) *Attorney, Agent, or Firm*—Alan Kamrath; Kamrath & Associates PA

(57) ABSTRACT

A pair of punch pliers include a handle, a control shank assembly, a punching member, and a connecting device. The handle has a first end provided with a grip portion, a second end provided with a punching seat and a mediate portion provided with a hollow receiving base. The control shank assembly includes two press members each pivotally mounted on the receiving base of the handle, and a press block mounted between the two press members. Thus, the blanks of the handle are juxtaposed to each other, and the blanks of each of the two press members of the control shank assembly are juxtaposed to each other, so that the wasted materials of the handle and each of the two press members are reduced largely, thereby decreasing the costs of fabrication of the punch pliers.

9 Claims, 9 Drawing Sheets

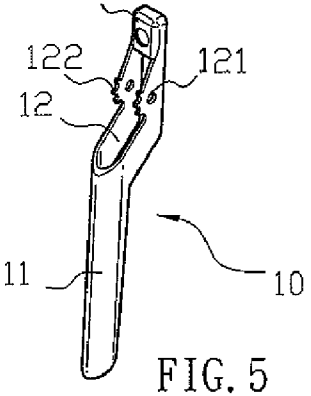
FIG. 4
FIG. 5
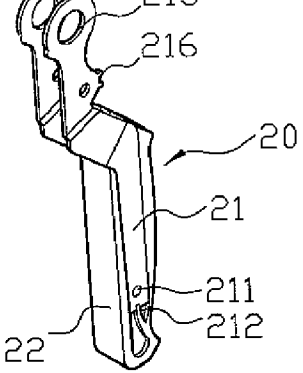
FIG. 7
FIG. 8

PUNCH PLIERS HAVING LOWER COSTS OF FABRICATION

BACKGROUND OF THE INVENTION

1. Field of the Invention

The present invention relates to a pair of punch pliers and, more particularly, to a pair of punch pliers for punching holes.

2. Description of the Related Art

A pair of conventional punch pliers in accordance with the prior art shown in FIG. 9 comprise a handle 50, a control shank 60 pivotally connected with the handle 50, a punching member 64 rotatably mounted on the control shank 60 and movable relative to the handle 50, and a connecting device 70 mounted between the handle 50 and the control shank 60 to connect the handle 50 and the control shank 60. The handle 50 has an upper end provided with a punching seat 53, a mediate portion provided with two first pivot holes 51 and two first toothed portions 52 and a forked lower end provided with two grip portions 54. A sleeve 55 is mounted on the two grip portions 54 of the handle 50. The control shank 60 has a forked upper end provided with two second pivot holes 61 corresponding to the first pivot holes 51 of the handle 50 and two second toothed portions 62 each meshing with a respective one of the two first toothed portions 52 of the handle 50. The forked upper end of the control shank 60 has an end portion provided with a mounting hole 63 for mounting the punching member 64. The connecting device 70 includes two connecting pieces 71 each having a first end abutting the handle 50 and a second end abutting the control shank 60, a first pivot pin 73 each extending through each of the two connecting pieces 71 and each of the first pivot holes 51 of the handle 50 so that the handle 50 is pivotable between the two connecting pieces 71 about the first pivot pin 73, a second pivot pin 74 each extending through each of the two connecting pieces 71 and each of the two second pivot holes 61 of the control shank 60 so that the control shank 60 is pivotable between the two connecting pieces 71 about the second pivot pin 74, and an elastic member 72 mounted on the first pivot pin 73 or the second pivot pin 74 and biased between the handle 50 and the control shank 60.

In operation, when the two grip portions 54 of the handle 50 and the lower end of the control shank 60 are pressed to move toward each other, the handle 50 and the control shank 60 are pivotable between the two connecting pieces 71 about the first pivot pin 73 and the second pivot pin 74 respectively so that the punching member 64 is movable toward the punching seat 53 of the handle 50 so as to perform a punching action.

As shown in FIGS. 10-12, the handle 50 is made by a punch press. In fabrication of the handle 50, the punch press has an upper die and a lower die which are designed to have a planar profile of the handle 50. Then, the upper die and the lower die of the punch press provide a shear force on a raw material 1 by the impact force applied by the punch press to shear and squeeze the raw material 1 to form the planar profile of the handle 50 on the raw material 1 so as to form the product of the handle 50.

As shown in FIGS. 13-15, the control shank 60 is made by a punch press. In fabrication of the control shank 60, the punch press has an upper die and a lower die which are designed to have a planar profile of the control shank 60. Then, the upper die and the lower die of the punch press provide a shear force on a raw material 1*a* by the impact force applied by the punch press to shear and squeeze the raw material 1*a* to form the planar profile of the control shank 60 on the raw material 1*a* so as to form the product of the control shank 60.

However, the handle 50 has a forked lower end, and the control shank 60 has a forked upper end so that the handle 50 and the control shank 60 produce many wasted materials as show in FIGS. 10 and 13, thereby increasing the costs of fabrication. In addition, the two grip portions 54 of the handle 50 have to be inserted into the forked upper end of the control shank 60, so that the punch pliers are not assembled easily and quickly. Further, the handle 50 has a forked lower end, and the control shank 60 has a forked upper end so that the handle 50 and the control shank 60 have a larger volume, thereby causing inconvenience in packaging, transportation and storage of the punch pliers.

BRIEF SUMMARY OF THE INVENTION

In accordance with the present invention, there is provided a pair of punch pliers, comprising a handle, a control shank assembly pivotally connected with the handle, a punching member mounted on the control shank assembly and movable relative to the handle, and a connecting device mounted between the handle and the control shank assembly to connect the handle and the control shank assembly. The handle has a first end provided with a grip portion, a second end provided with a punching seat and a mediate portion provided with a hollow receiving base located between the grip portion and the punching seat. The control shank assembly includes two press members each pivotally mounted on the receiving base of the handle, and a press block mounted between the two press members.

The primary objective of the present invention is to provide a pair of punch pliers having lower costs of fabrication.

Another objective of the present invention is to provide a pair of punch pliers, wherein the blanks of the handle are juxtaposed to each other on the raw material, and the blanks of each of the two press members of the control shank assembly are juxtaposed to each other on the raw material, so that the wasted materials of the handle and each of the two press members of the control shank assembly are reduced largely, thereby greatly decreasing the costs of fabrication of the punch pliers.

A further objective of the present invention is to provide a pair of punch pliers, wherein each of the two press members of the control shank assembly is mounted on the receiving base of the handle easily and quickly, so that the punch pliers are assembled easily and quickly.

A further objective of the present invention is to provide a pair of punch pliers, wherein the handle and each of the two press members of the control shank assembly have a smaller volume, thereby saving the storage space, and thereby facilitating packaging, transportation and storage of the punch pliers.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

FIG. 4 is a planar view of the handle of the punch pliers as shown in

FIG. 3.

FIG. 5 is a perspective view of the handle of the punch pliers as shown in FIG. 4.

Figure 1:
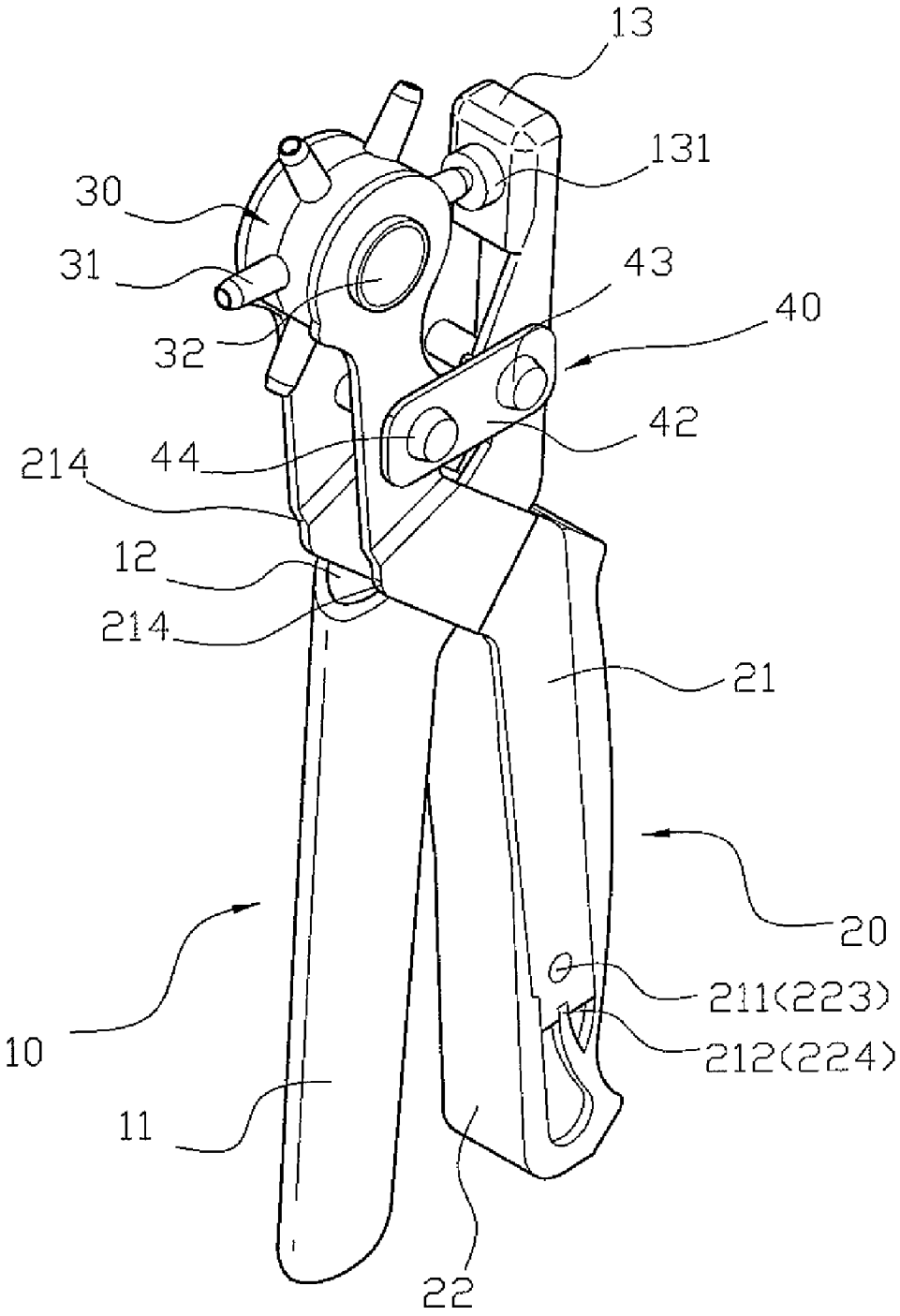
FIG. 1 is a perspective view of a pair of punch pliers in accordance with the preferred embodiment of the present invention.
Figure 6:
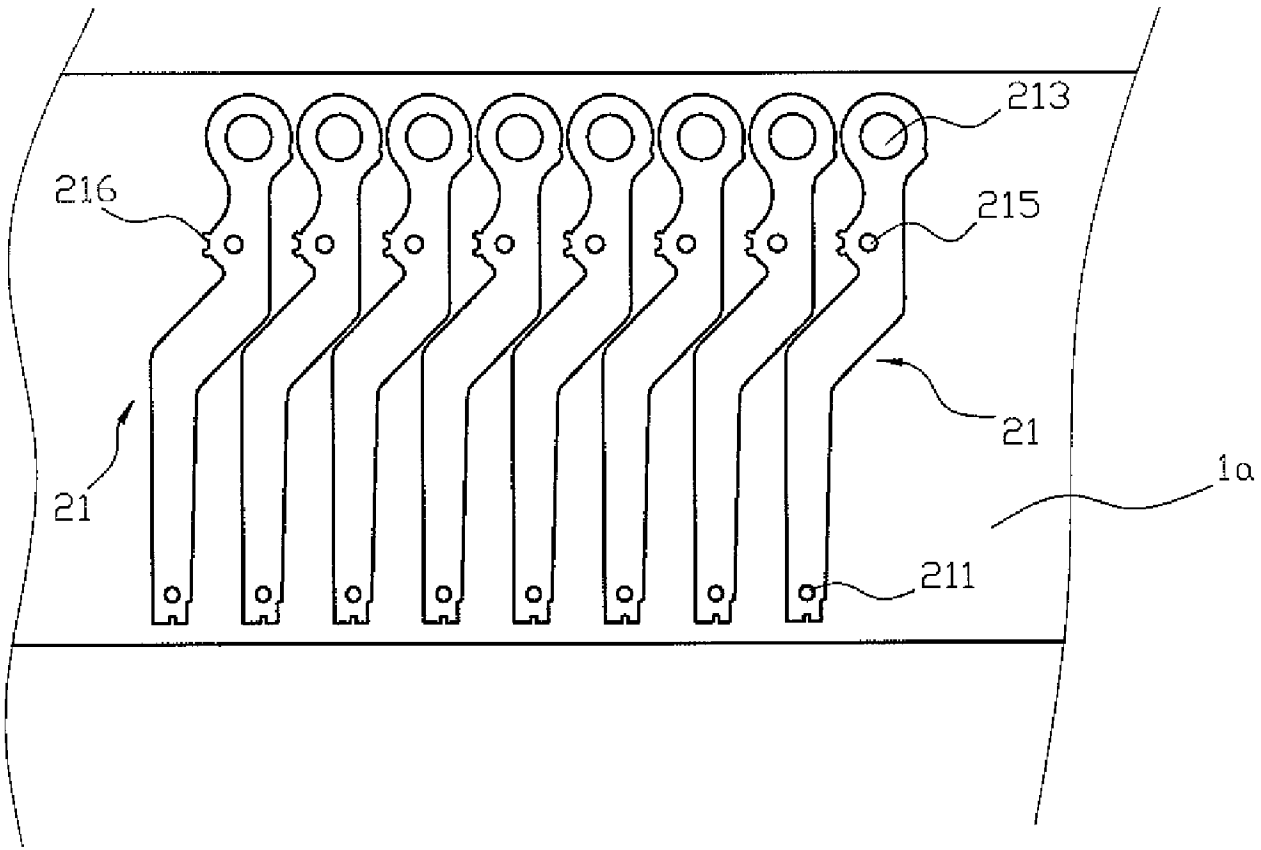

FIG. 6 is a planar view showing fabrication of a press member of the punch pliers as shown in FIG. 1.

FIG. 7 is a planar view of two press members of the punch pliers as shown in FIG. 6.

FIG. 8 is a perspective view of the two press members of the punch pliers as shown in FIG. 7.

Figure 9:
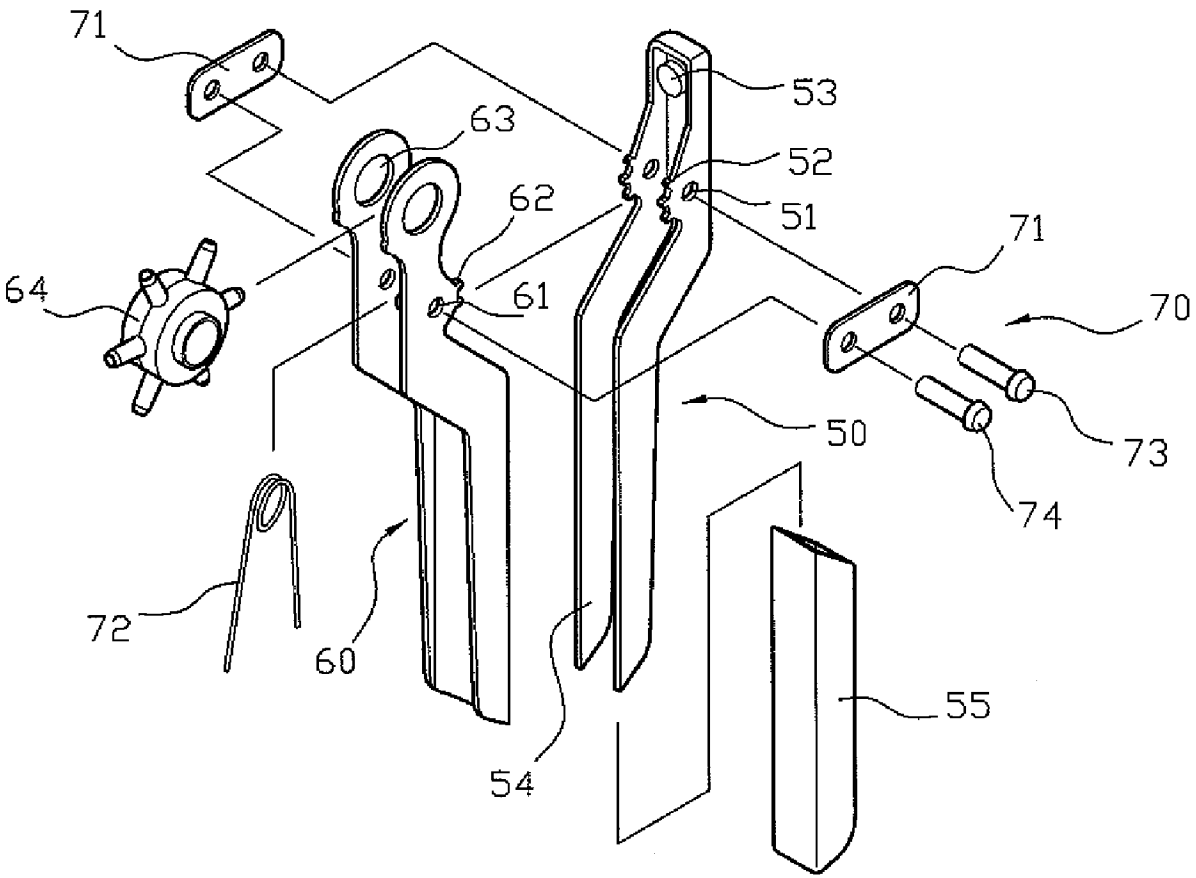
FIG. 9 PRIOR ART

FIG. 9 is an exploded perspective view of a pair of conventional punch pliers in accordance with the prior art.

Figure 10:
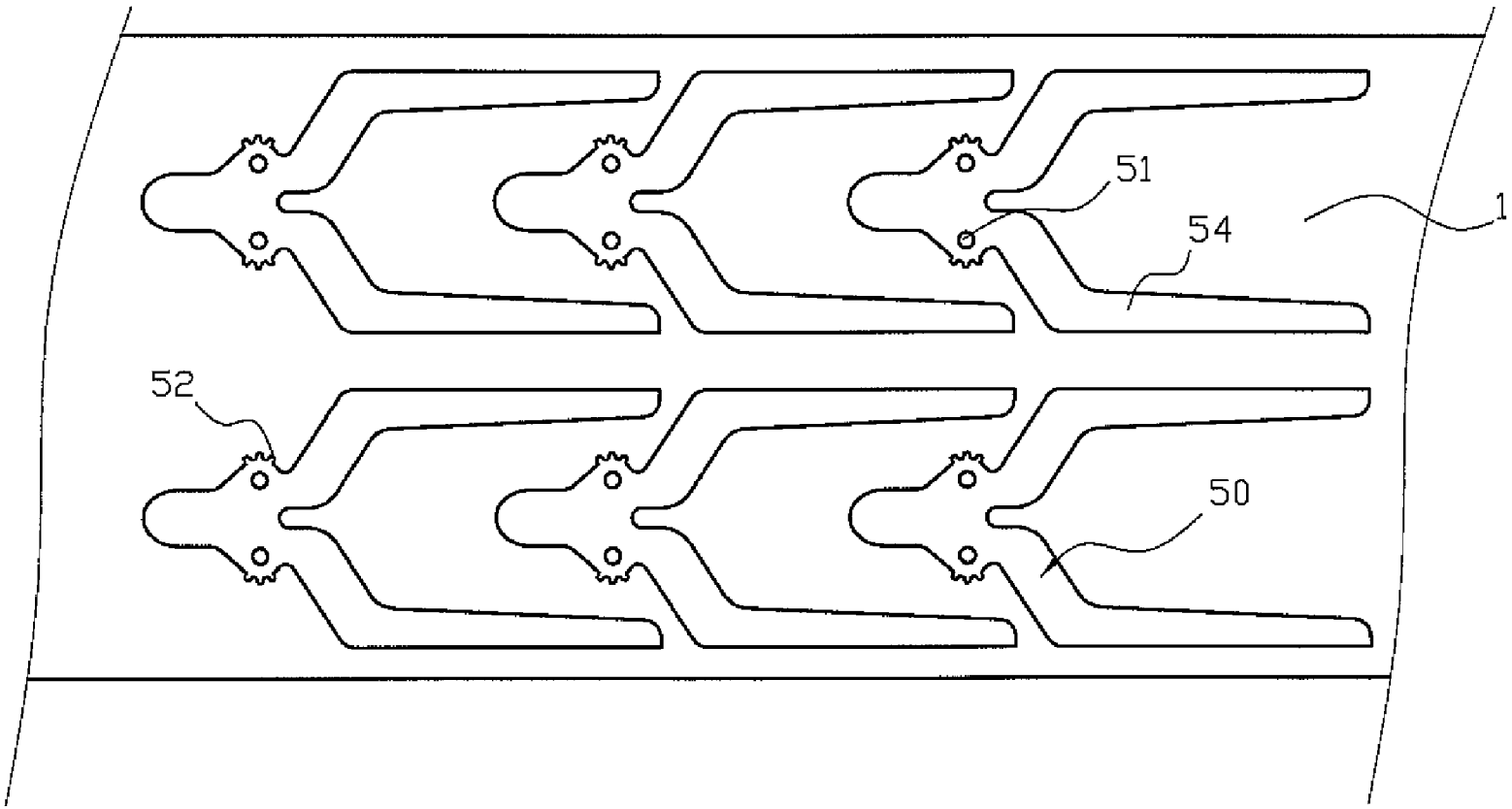
FIG. 10 PRIOR ART

FIG. 10 is a planar view showing fabrication of a handle of the conventional punch pliers as shown in FIG. 9.

Figure 11:
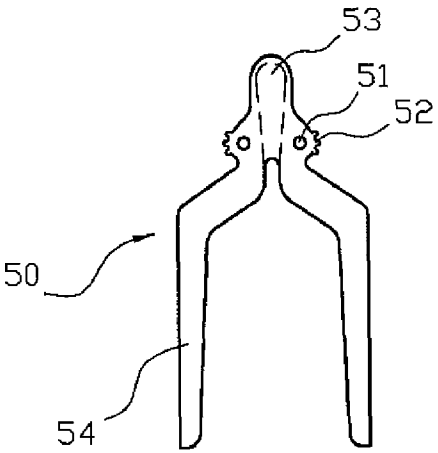
FIG. 11 PRIOR ART

FIG. 11 is a planar view of the handle of the conventional punch pliers as shown in FIG. 10.

Figure 12:
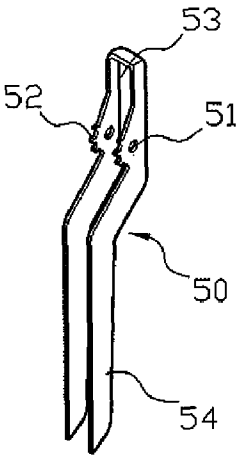
FIG. 12 PRIOR ART

FIG. 12 is a perspective view of the handle of the conventional punch pliers as shown in FIG. 11.

Figure 13:
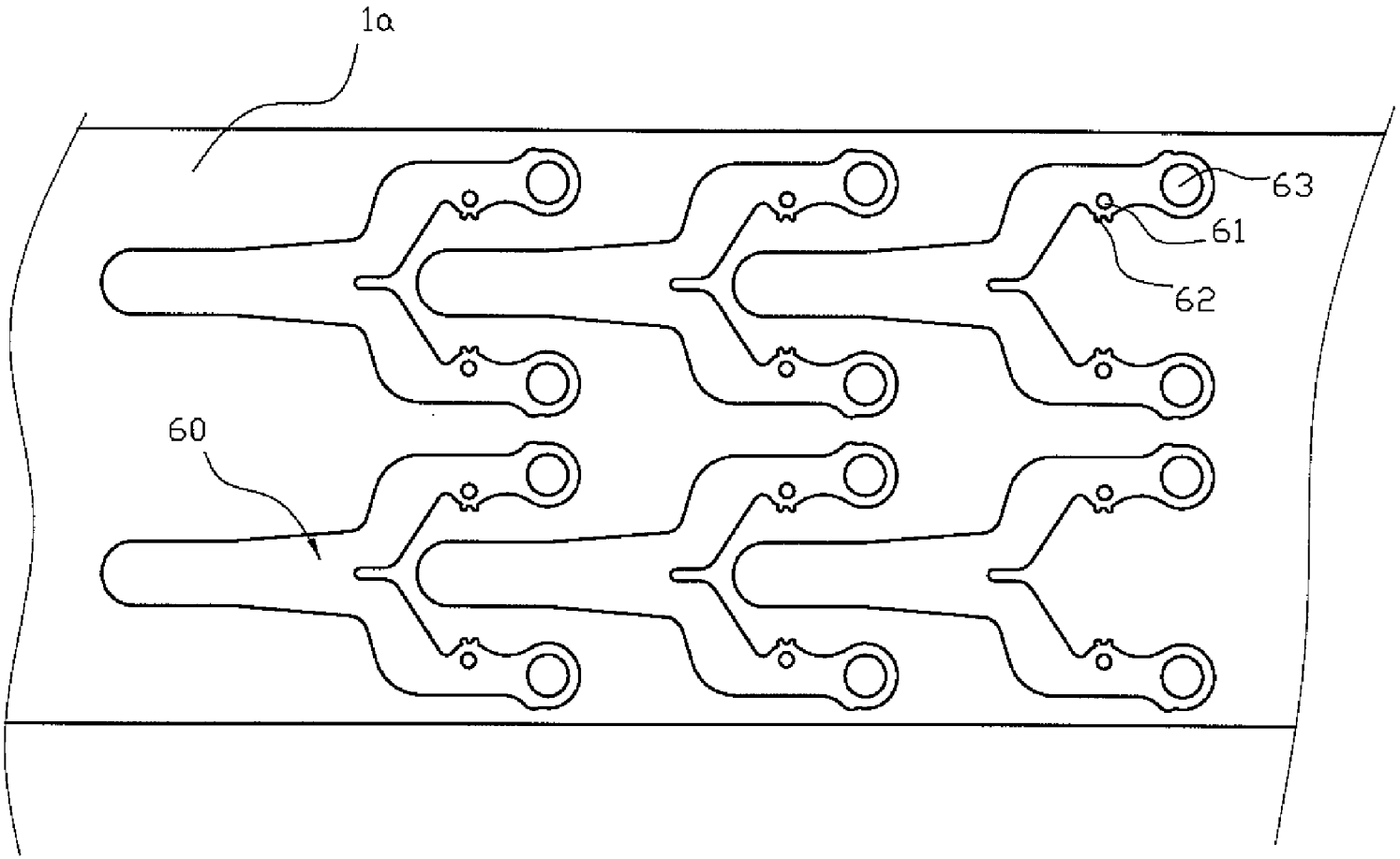
FIG. 13 PRIOR ART

FIG. 13 is a planar view showing fabrication of a control shank of the conventional punch pliers as shown in FIG. 9.

Figure 14:
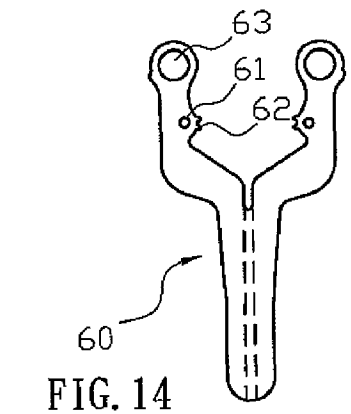
FIG. 14 PRIOR ART

FIG. 14 is a planar view of the control shank of the conventional punch pliers as shown in FIG. 13.

Figure 15:
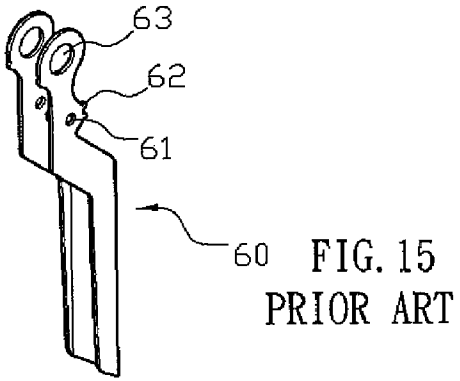
FIG. 15 PRIOR ART

FIG. 15 is a perspective view of the control shank of the conventional punch pliers as shown in FIG. 14.

DETAILED DESCRIPTION OF THE INVENTION

Figure 2:
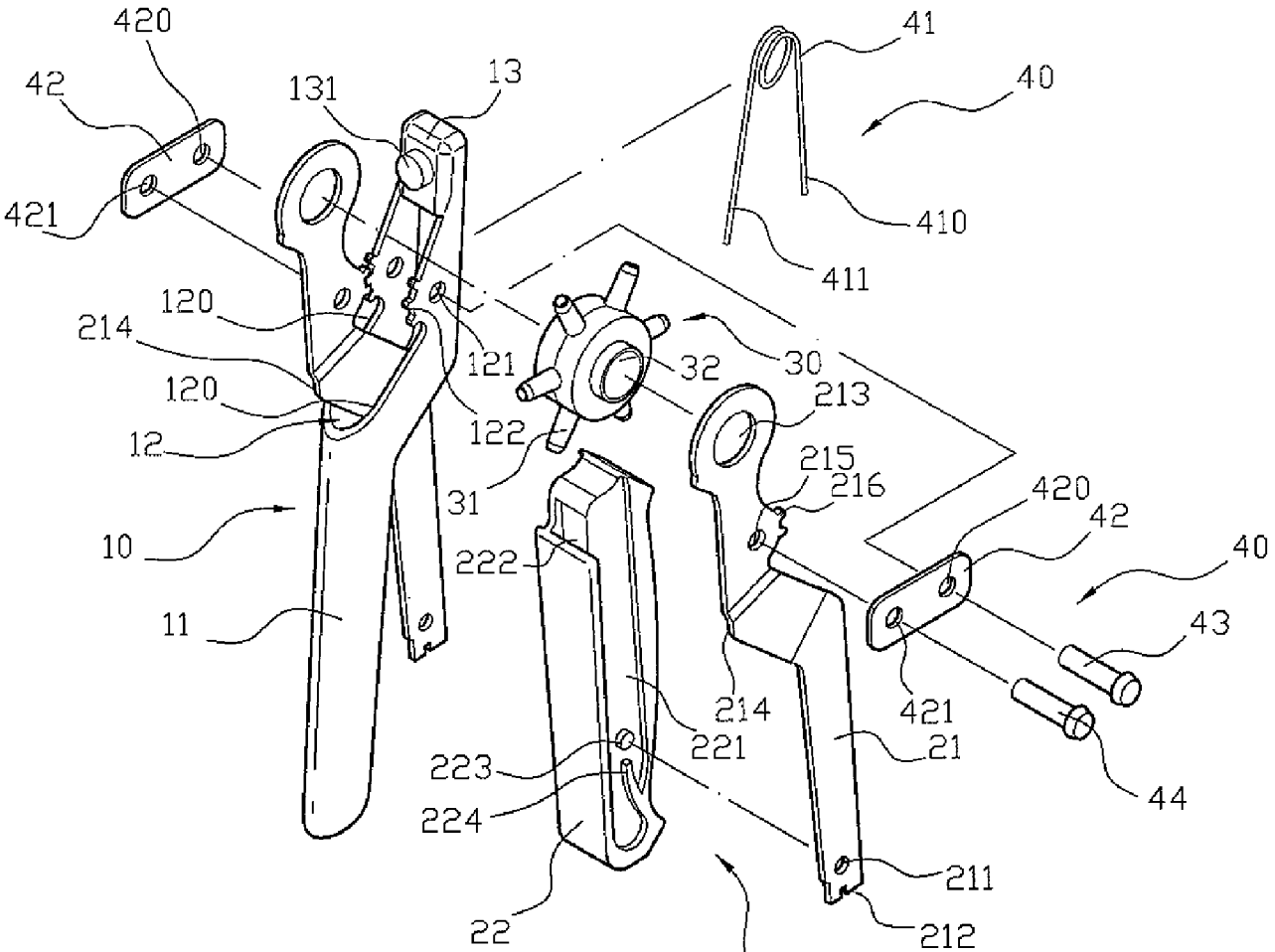
FIG. 2 is an exploded perspective view of the punch pliers as shown in FIG. 1.

Referring to the drawings and initially to FIGS. 1 and 2, a pair of punch pliers in accordance with the preferred embodiment of the present invention comprise a handle 10, a control shank assembly 20 pivotally connected with the handle 10, a punching member 30 mounted on the control shank assembly 20 and movable relative to the handle 10, and a connecting device 40 mounted between the handle 10 and the control shank assembly 20 to connect the handle 10 and the control shank assembly 20.

The handle 10 is a bent sheet plate and has a first end provided with a grip portion 11, a second end provided with a punching seat 13 and a mediate portion provided with a hollow receiving base 12 located between the grip portion 11 and the punching seat 13. The receiving base 12 of the handle 10 has two opposite sidewalls 120. Each of the two sidewalls 120 of the receiving base 12 of the handle 10 is provided with a first pivot hole 121 and a first toothed portion 122. The punching seat 13 of the handle 10 is provided with a circular punching block 131.

The control shank assembly 20 includes two press members 21 each pivotally mounted on the receiving base 12 of the handle 10, and a press block 22 mounted between the two press members 21.

The two press members 21 of the control shank assembly 20 are separated from each other. Each of the two press members 21 of the control shank assembly 20 is an elongate sheet plate, wherein one of the two press members 21 of the control shank assembly 20 is received in the receiving base 12 of the handle 10, and the other one of the two press members 21 of the control shank assembly 20 is located outside of the receiving base 12 of the handle 10. Each of the two press members 21 of the control shank assembly 20 abuts a respective one of the two sidewalls 120 of the receiving base 12 of the handle 10. Each of the two press members 21 of the control shank assembly 20 has a first end movable relative to the grip portion 11 of the handle 10, a second end movable relative to the punching seat 13 of the handle 10, and a bent mediate portion provided with a recessed limit portion 214 that is movable to press a respective one of the two sidewalls 120 of the receiving base 12 of the handle 10 to limit a further movement of each of the two press members 21 of the control shank assembly 20 relative to the handle 10. The first end of each of the two press members 21 of the control shank assembly 20 is provided with a positioning hole 211 and has an end face provided with a positioning breach 212. The second end of each of the two press members 21 of the control shank assembly 20 is provided with a second pivot hole 215 corresponding to the first pivot hole 121 and a second toothed portion 216 meshing with the first toothed portion 122 of a respective one of the two sidewalls 120 of the receiving base 12 of the handle 10. The second end of each of the two press members 21 of the control shank assembly 20 has an end portion provided with a circular limit hole 213.

The press block 22 of the control shank assembly 20 is a solid body made of plastic material. The press block 22 of the control shank assembly 20 is mounted between the first ends of the two press members 21 and has two opposite sides each provided with an elongate positioning channel 221 to receive the first end of a respective one of the two press members 21. Each of the two opposite sides of the press block 22 of the control shank assembly 20 is provided with a positioning stub 223 inserted into the positioning hole 211 of the respective press member 21 and a positioning rib 224 inserted into the positioning breach 212 of the respective press member 21. The press block 22 of the control shank assembly 20 has a periphery provided with a retaining groove 222.

The punching member 30 is rotatably mounted between the second ends of the two press members 21 of the control shank assembly 20 and has a periphery provided with a plurality of punching posts 31 having different diameters and each movable to press the punching block 131 of the punching seat 13 of the handle 10. The punching member 30 has two opposite sides each provided with a circular limit protrusion 32 rotatably mounted in the limit hole 213 of a respective one of the two press members 21 of the control shank assembly 20.

The connecting device 40 includes two connecting pieces 42 each having a first end abutting the handle 10 and a second end abutting a respective one of the two press members 21 of the control shank assembly 20, a first pivot pin 43 each extending through each of the two connecting pieces 42 and the first pivot hole 121 of each of the two sidewalls 120 of the receiving base 12 of the handle 10 so that the handle 10 is pivotable between the two connecting pieces 42 about the first pivot pin 43, a second pivot pin 44 each extending through each of the two connecting pieces 42 and the second pivot hole 215 of each of the two press members 21 of the control shank assembly 20 so that each of the two press members 21 of the control shank assembly 20 is pivotable between the two connecting pieces 42 about the second pivot pin 44, and an elastic member 41 mounted on the first pivot pin 43 and biased between the grip portion 11 of the handle 10 and the press block 22 of the control shank assembly 20 to open the punching member 30 relative to the punching seat 13 of the handle 10. The first end of each of the two connecting pieces 42 of the connecting device 40 is provided with a first through hole 420 aligning with the first pivot hole 121 of each of the two sidewalls 120 of the receiving base 12 of the handle 10 to allow passage of the first pivot pin 43, and the second end of each of the two connecting pieces 42 is provided with a second through hole 421 aligning with the second pivot hole 215 of each of the two press members 21 of the control shank assembly 20 to allow passage of the second pivot pin 44. The elastic member 41 of the connecting device 40 has a first end 410 secured in the retaining groove 222 of the press block 22 of the control shank assembly 20 and a second end 411 abutting an inner side of the grip portion 11 of the handle 10.

In operation, when the grip portion 11 of the handle 10 and the press block 22 of the control shank assembly 20 are pressed to move toward each other, the handle 10 and the control shank assembly 20 are pivotable between the two connecting pieces 42 about the first pivot pin 43 and the second pivot pin 44 respectively so that the punching member 30 is movable toward the punching seat 13 of the handle 10 until one of the punching posts 31, of the punching member 30 presses the punching block 131 of the punching seat 13 of the handle 10 so as to perform a punching action. At this time, the second toothed portion 216 of each of the two press members 21 of the control shank assembly 20 meshes with the first toothed portion 122 of a respective one of the two sidewalls 120 of the receiving base 12 of the handle 10 so that the handle 10 and the control shank assembly 20 are pivoted in concert with each other. After the force applied on the grip portion 11 of the handle 10 and the press block 22 of the control shank assembly 20 disappears, the grip portion 11 of the handle 10 and the press block 22 of the control shank assembly 20 are pushed to space from each other by the restoring force of the elastic member 41 of the connecting device 40 so as to open the punching member 30 relative to the punching seat 13 of the handle 10.

Figure 3:
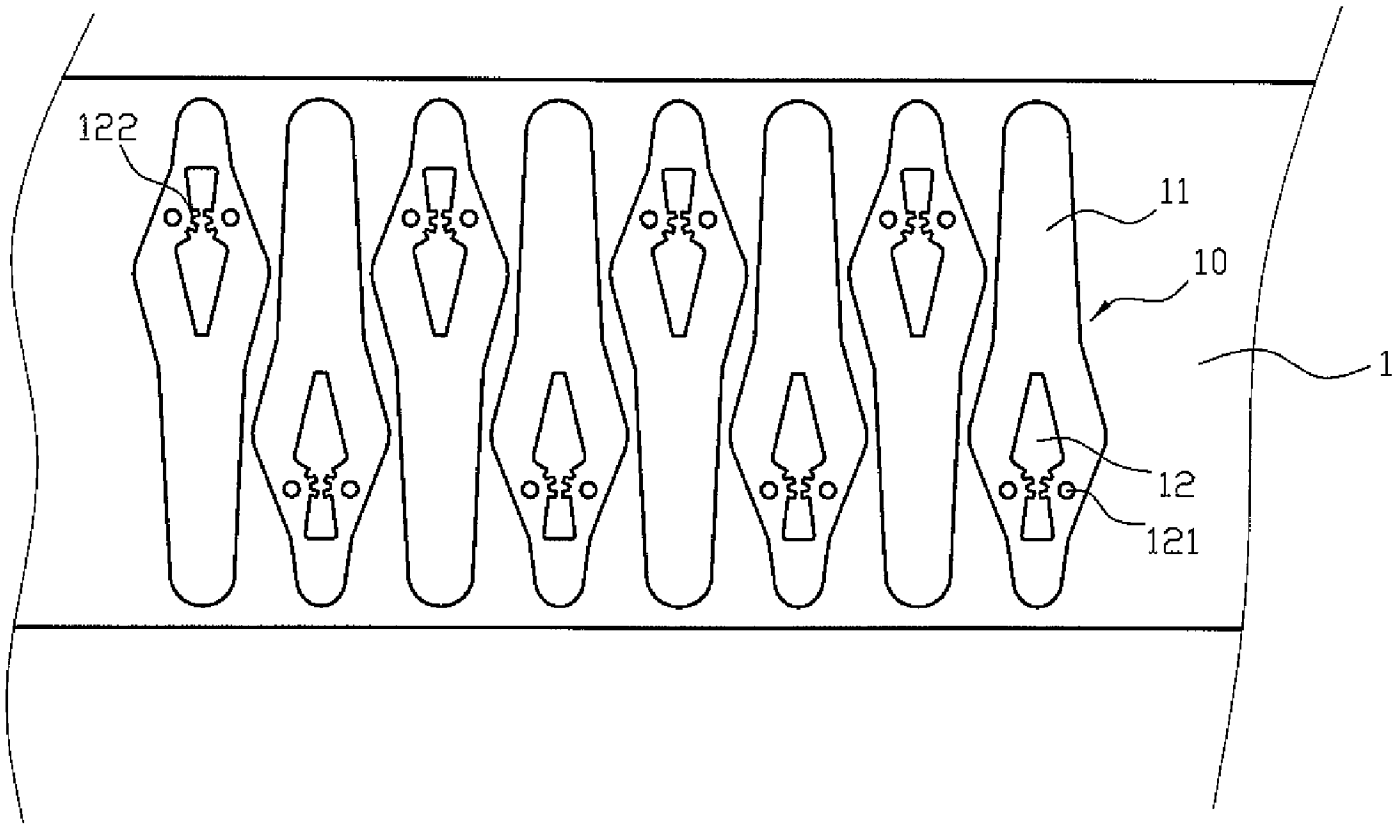
FIG. 3 is a planar view showing fabrication of a handle of the punch pliers as shown in FIG. 1.

As shown in FIGS. 3-5, the handle 10 is made by a punch press. In fabrication of the handle 10, the punch press has an upper die and a lower die which are designed to have a planar profile of the handle 10. Then, the upper die and the lower die of the punch press provide a shear force on a raw material 1 by the impact force applied by the punch press so as to form the planar profile of the handle 10 on the raw material 1. Then, the punch press bends the handle 10 downward, presses and squeezes the blank of the handle 10 to form a substantially inverted U-shaped cap at the punching seat 13 of the handle 10 and to form a mounting hole in the punching seat 13 of the handle 10. Then, the blank of the handle 10 is placed on a die of a small-size punch press, and the punching block 131 is punched into the hole in the punching seat 13 of the handle 10 so as to form a product of the handle 10.

As shown in FIGS. 6-8, each of the two press members 21 of the control shank assembly 20 is made by a punch press. In fabrication of each of the two press members 21 of the control shank assembly 20, the punch press has an upper die and a lower die which are designed to have a planar profile of each of the two press members 21 of the control shank assembly 20. Then, the upper die and the lower die of the punch press provide a shear force on a raw material 1*a* by the impact force applied by the punch press to shear and squeeze the raw material 1*a* to form the planar profile of each of the two press members 21 of the control shank assembly 20 on the raw material 1*a* so as to form the product of each of the two press members 21 of the control shank assembly 20.

Accordingly, the blanks of the handle 10 are juxtaposed to each other on the raw material 1 as shown in FIG. 3, and the blanks of each of the two press members 21 of the control shank assembly 20 are juxtaposed to each other on the raw material 1*a* as shown in FIG. 6, so that the wasted materials of the handle 10 and each of the two press members 21 of the control shank assembly 20 are reduced largely, thereby greatly decreasing the costs of fabrication of the punch pliers. In addition, each of the two press members 21 of the control shank assembly 20 is mounted on the receiving base 12 of the handle 10 easily and quickly, so that the punch pliers are assembled easily and quickly. Further, the handle 10 and each of the two press members 21 of the control shank assembly 20 have a smaller volume, thereby saving the storage space, and thereby facilitating packaging, transportation and storage of the punch pliers.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A pair of punch pliers, comprising:

a handle;

a control shank assembly pivotally connected with the handle;

a punching member mounted on the control shank assembly and movable relative to the handle;

a connecting device mounted between the handle and the control shank assembly to connect the handle and the control shank assembly;

wherein the handle has a first end provided with a grip portion, a second end provided with a punching seat and a mediate portion provided with a hollow receiving base located between the grip portion and the punching seat;

the control shank assembly includes two press members each pivotally mounted on the receiving base of the handle, and a press block mounted between the two press members;

one of the two press members of the control shank assembly is received in the receiving base of the handle;

the other one of the two press members of the control shank assembly is located outside of the receiving base of the handle;

the receiving base of the handle has two opposite sidewalls;

each of the two press members of the control shank assembly abuts a respective one of the two sidewalls of the receiving base of the handle;

each of the two press members of the control shank assembly has a first end movable relative to the grip portion of the handle, a second end movable relative to the punching seat of the handle, and a bent mediate portion provided with a recessed limit portion that is movable to press a respective one of the two sidewalls of the receiving base of the handle to limit a further movement of each of the two press members of the control shank assembly relative to the handle;

the press block of the control shank assembly is mounted between the first ends of the two press members;

the press block of the control shank assembly has two opposite sides each provided with an elongate positioning channel to receive the first end of a respective one of the two press members.

2. The punch pliers in accordance with claim 1, wherein the press block of the control shank assembly is a solid body made of plastic material.

3. The punch pliers in accordance with claim 1, wherein the first end of each of the two press members of the control shank assembly is provided with a positioning hole;

each of the two opposite sides of the press block of the control shank assembly is provided with a positioning stub inserted into the positioning hole of the respective press member.

4. The punch pliers in accordance with claim 1, wherein the first end of each of the two press members of the control shank assembly has an end face provided with a positioning breach;

each of the two opposite sides of the press block of the control shank assembly is provided with a positioning rib inserted into the positioning breach of the respective press member.

5. The punch pliers in accordance with claim 1, wherein the handle is a bent sheet plate.

6. The punch pliers in accordance with claim 1, wherein each of the two press members of the control shank assembly is an elongate sheet plate.

7. The punch pliers in accordance with claim 1, wherein the two press members of the control shank assembly are separated from each other.

8. A pair of punch pliers, comprising:

a handle;

a control shank assembly pivotally connected with the handle;

a punching member mounted on the control shank assembly and movable relative to the handle;

a connecting device mounted between the handle and the control shank assembly to connect the handle and the control shank assembly;

wherein the handle has a first end provided with a grip portion, a second end provided with a punching seat and a mediate portion provided with a hollow receiving base located between the grip portion and the punching seat;

the control shank assembly includes two press members each pivotally mounted on the receiving base of the handle, and a press block mounted between the two press members;

one of the two press members of the control shank assembly is received in the receiving base of the handle;

the other one of the two press members of the control shank assembly is located outside of the receiving base of the handle;

the receiving base of the handle has two opposite sidewalls;

each of the two press members of the control shank assembly abuts a respective one of the two sidewalls of the receiving base of the handle;

each of the two press members of the control shank assembly has a first end movable relative to the grip portion of the handle, a second end movable relative to the punching seat of the handle, a bent mediate portion provided with a recessed limit portion that is movable to press a respective one of the two sidewalls of the receiving base of the handle to limit a further movement of each of the two press members of the control shank assembly relative to the handle;

each of the two sidewalls of the receiving base of the handle is provided with a first pivot hole and a first toothed portion;

the second end of each of the two press members of the control shank assembly is provided with a second pivot hole corresponding to the first pivot hole and a second toothed portion meshing with the first toothed portion of a respective one of the two sidewalls of the receiving base of the handle;

the connecting device includes:

two connecting pieces each having a first end abutting the handle and a second end abutting a respective one of the two press members of the control shank assembly;

a first pivot pin each extending through each of the two connecting pieces and the first pivot hole of each of the two sidewalls of the receiving base of the handle so that the handle is pivotable between the two connecting pieces about the first pivot pin;

a second pivot pin each extending through each of the two connecting pieces and the second pivot hole of each of the two press members of the control shank assembly so that each of the two press members of the control shank assembly is pivotable between the two connecting pieces about the second pivot pin;

the connecting device further includes:

an elastic member mounted on the first pivot pin and biased between the grip portion of the handle and the press block of the control shank assembly;

the press block of the control shank assembly has a periphery provided with a retaining groove;

the elastic member of the connecting device has a first end secured in the retaining groove of the press block of the control shank assembly and a second end abutting an inner side of the grip portion of the handle.

9. The punch pliers in accordance with claim 8, wherein the first end of each of the two connecting pieces of the connecting device is provided with a first through hole aligning with the first pivot hole of each of the two sidewalls of the receiving base of the handle to allow passage of the first pivot pin;

the second end of each of the two connecting pieces is provided with a second through hole aligning with the second pivot hole of each of the two press members of the control shank assembly to allow passage of the second pivot pin.

* * * * *